US008161777B2

(12) United States Patent
Loss

(10) Patent No.: US 8,161,777 B2
(45) Date of Patent: Apr. 24, 2012

(54) WASHING MACHINE WITH A REMOVABLE BASKET

(76) Inventor: Aurimar Antonio Bassanezi Loss, Timbo (BR)

( * ) Notice: Subject to any disclaimer, the term of this patent is extended or adjusted under 35 U.S.C. 154(b) by 0 days.

(21) Appl. No.: 13/103,128

(22) Filed: May 9, 2011
(Under 37 CFR 1.47)

(65) Prior Publication Data

US 2012/0006066 A1 Jan. 12, 2012

Related U.S. Application Data

(63) Continuation of application No. PCT/BR2009/000379, filed on Nov. 12, 2009.

(30) Foreign Application Priority Data

Nov. 12, 2008 (BR) ..... 0805181

(51) Int. Cl.
*D06F 21/00* (2006.01)
*D06F 23/00* (2006.01)
*D06F 25/00* (2006.01)

(52) U.S. Cl. ..... 68/140; 68/142

(58) Field of Classification Search ..... 68/140, 68/142

See application file for complete search history.

(56) References Cited

U.S. PATENT DOCUMENTS 4,744,228 A * 5/1988 Goldberg ..... 68/20
2007/0261448 A1* 11/2007 Ho et al. ..... 68/140

FOREIGN PATENT DOCUMENTS

JP 01250298 A * 10/1989
KR 2001097200 A * 11/2001

OTHER PUBLICATIONS

PCT/BR2009/000379; WO2010/054459 ; "A Washing Machine With a Removable Basket" Published May 29, 2010; Aurimar Antonio Bassanezi Loss.

* cited by examiner

*Primary Examiner* — Michael Barr
*Assistant Examiner* — Charles W Kling
(74) *Attorney, Agent, or Firm* — Patent Law Agency, LLC; Peter Ganjian

(57) ABSTRACT

A washing machine with a removable basket that comprises a fixing structure of the tank that has a frame (10) provided with orthogonal projections (11) on the base, including springs (30) on the upper edges and shock-absorbers (40) on the lower edges; a tank (20) that has, in the intermediary region of the surface, a ring (201) that connects the springs (30), said tank (20) having the base provided with a bearing (21) fixed, on the external extremity, onto a moving pulley (22) actuated by a motor (23), the motor and an electric pump being fixed at the base of the tank (20); a structure for supporting the basket (50) is arranged in the inner portion of the tank (20), said supporting structure (50) having a set of arms that follow the shape of the tank (20), with the arms being centrally joined on an axis (51) attachable to the bearing (21) of the tank (20) and attached directly to the mechanical set of the washing machine, and a removable basket (60) arranged in the inner portion of the tank (20) and fixed, on the supporting structure, (50) into the furrows (61) arranged on the external surface of said removable basket (60).

6 Claims, 5 Drawing Sheets

WASHING MACHINE WITH A REMOVABLE BASKET

CROSS-REFERENCE TO RELATED APPLICATIONS

This Application is a CONTINUATION of a co-pending International Patent Application No. PCT/BR2009/000379 with an international filing date of 12 Nov. 2009 that designated the United States of America, which claims the benefit of priority of the Federative Republic of Brazil Patent Application No. PI 0805181-0, with a filing date of 12 Nov. 2008, the entire disclosures of all Applications is expressly incorporated by reference in their entirety herein.

FIELD OF THE INVENTION

This invention relates to a washing machine with a removable basket. More particularly, it refers to a washing machine provided with a fixing structure that allows a removable basket to be fitted.

BACKGROUND OF THE INVENTION

Basically, washing machines comprise a cabinet provided with a drum in which the clothes to be washed and/or centrifuged are placed. The inner area of the drum is accessed through an opening arranged on the top or on the front surface of the cabinet, said opening being protected by a door. After the washing machine has finished its operation, the user has to remove the clothes from the drum of the washing machine, place them in a bucket, and take to a clothesline to dry.

The literature describes washing machines that allow removing the basket in which the clothes to be washed are placed in such a manner that the user has easy access to the washed clothes and uses the basket to take them to the clothesline.

The invention U.S. Pat. No. 6,393,873 and U.S. Pat. No. 6,092,400 describe washing machines provided with a metallic cabinet for supporting a tank that contains a fixed intermediary basket inside, which provides a groove of a removable basket, said fixed intermediary basket rotating the removable basket and fastening it to the tank.

However, it is desired to provide a washing machine with a removable basket that has a simplified structure for sustaining the basket, allowing the removable basket to be fastened to and rotated directly in the tank, thus eliminating the need for a fixed intermediary basket arranged between the tank and the removable basket, which increases the cost and the weight of the end product, such a washing machine with a removable basket being described and claimed herein.

SUMMARY

In general, the present invention refers to a washing machine with a removable basket that comprises a fixing structure of the tank that has a frame, including the springs on the upper edges and shock-absorbers on the lower edges; a tank that, in the intermediary portion of the surface, has a ring that connects the springs, said tank having a base provided with a bearing attached, on the external extremity, to a moving pulley actuated by a motor, the motor and an electric pump being fastened to the base of the tank; a structure for supporting the basket is arranged in the inner portion of the tank, said supporting structure having a set of arms that follow the shape of the tank, with the arms being centrally joined on an axis attachable to the bearing of the tank and fixed directly to the mechanical set of the washing machine, and a removable basket arranged in the inner portion of the tank and attached to the supporting structure through a groove of the arms of the supporting structure in the furrows disposed on the external surface of said removable basket.

The invention is characterized by a washing machine provided with a frame for fixing the tank that enables the structuring mechanical components to be simplified.

The invention is characterized by a washing machine provided with a tank and a removable basket fixed onto and actuated by said tank through a supporting structure, thus eliminating the need for a fixed intermediary basked arranged between the tank and the removable basket, reducing the cost and the weight of the end product.

The invention is characterized by a washing machine provided with a removable basket that allows the easier cleanup of the drain, tank and basket since the basket can be removed from the tank and there is easier access to the latter.

The invention is characterized by a washing machine provided with a removable basket that has a detachable rear cover that provides easier access to the mechanical and electrical parts, thus facilitating and speeding up the maintenance procedures.

The invention is characterized by a washing machine provided with a removable basket that has a metallic ring around the tank for reinforcing, sustaining and coupling the springs that sustain the tank.

DETAILED DESCRIPTION OF THE INVENTION

Figure 1:
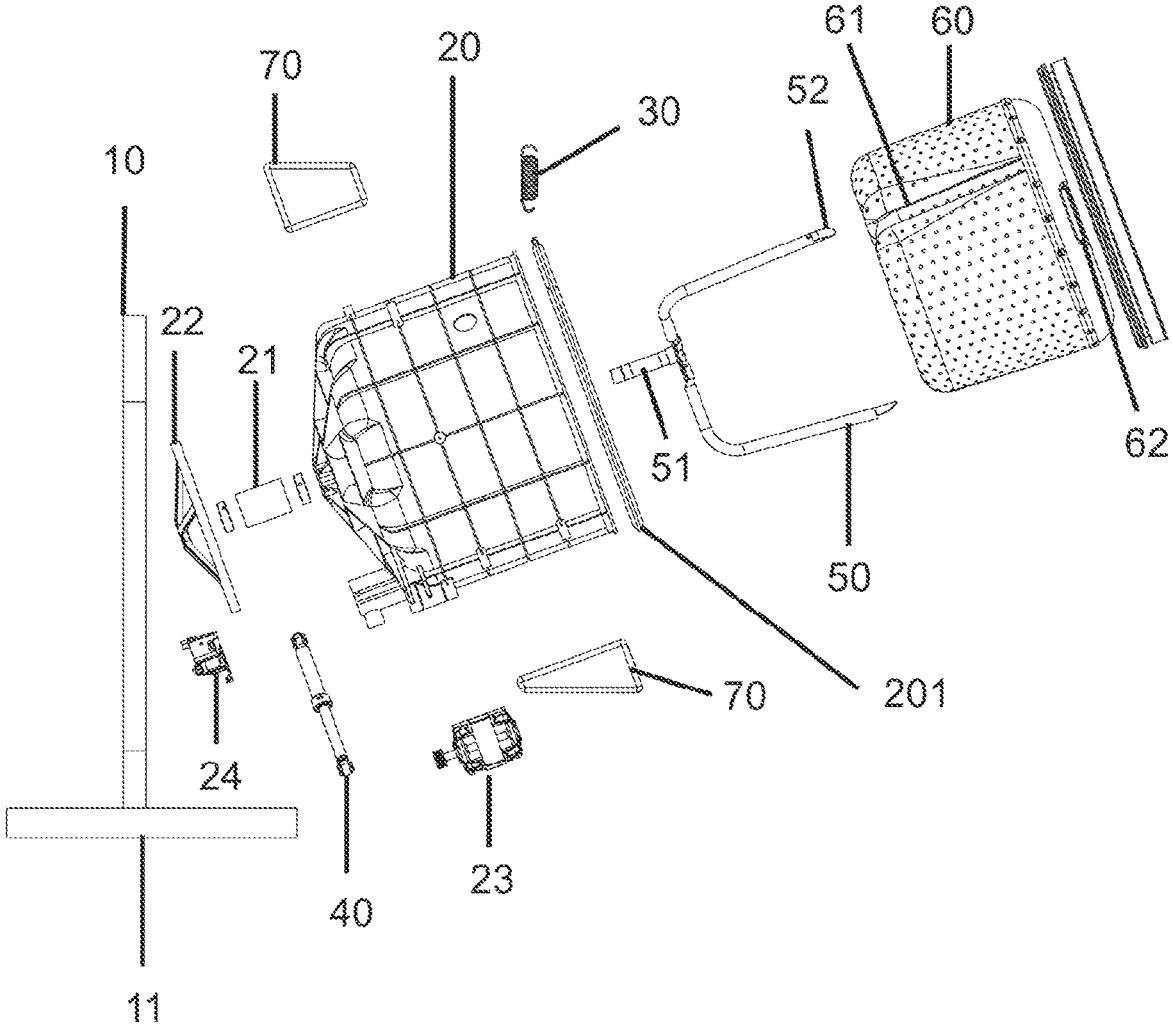
FIG. 1 is an exploded view of the fixing structure of the tank
Figure 2:
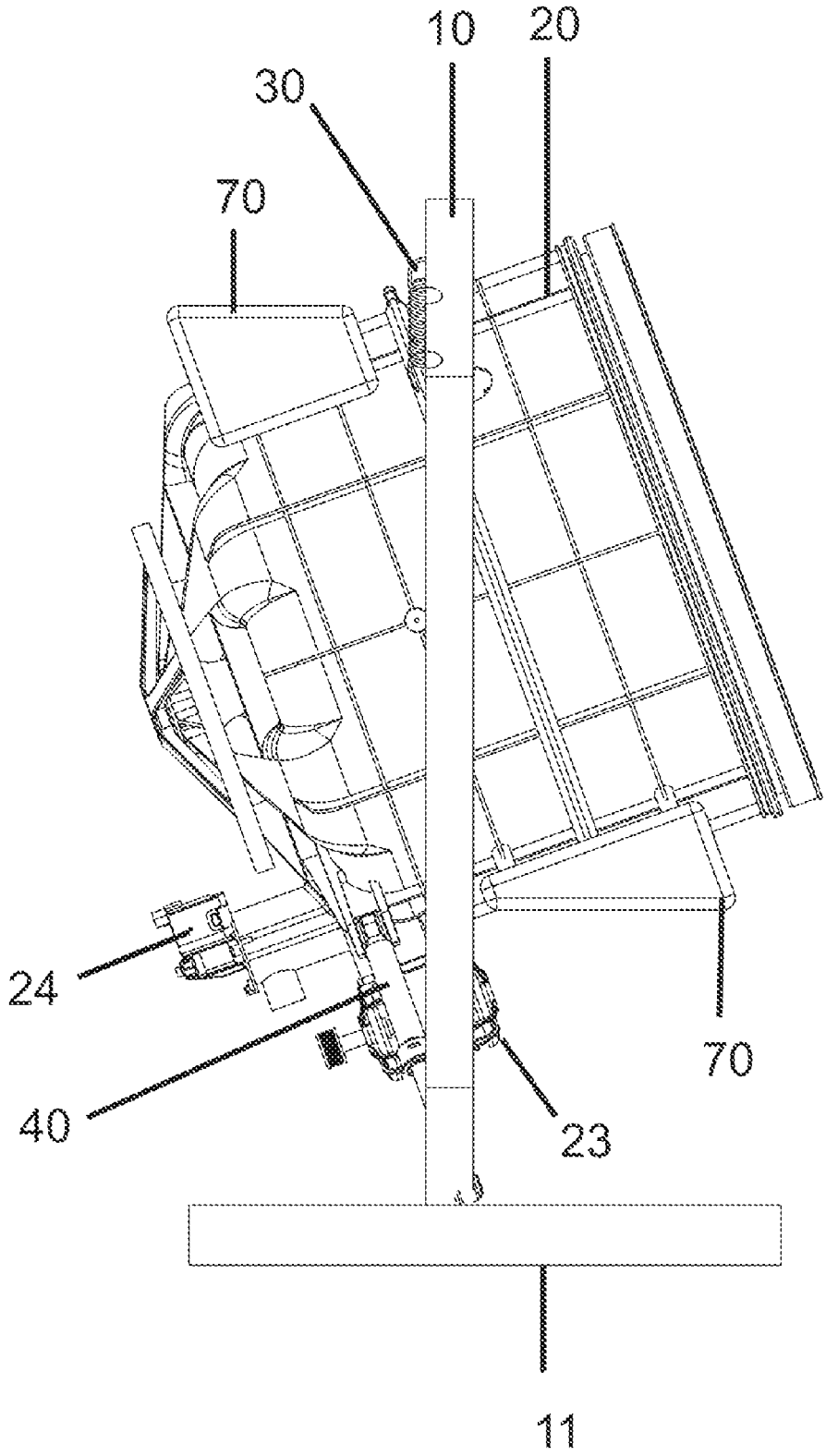
FIG. 2 is a side view of the fixing structure of the tank
Figure 3:
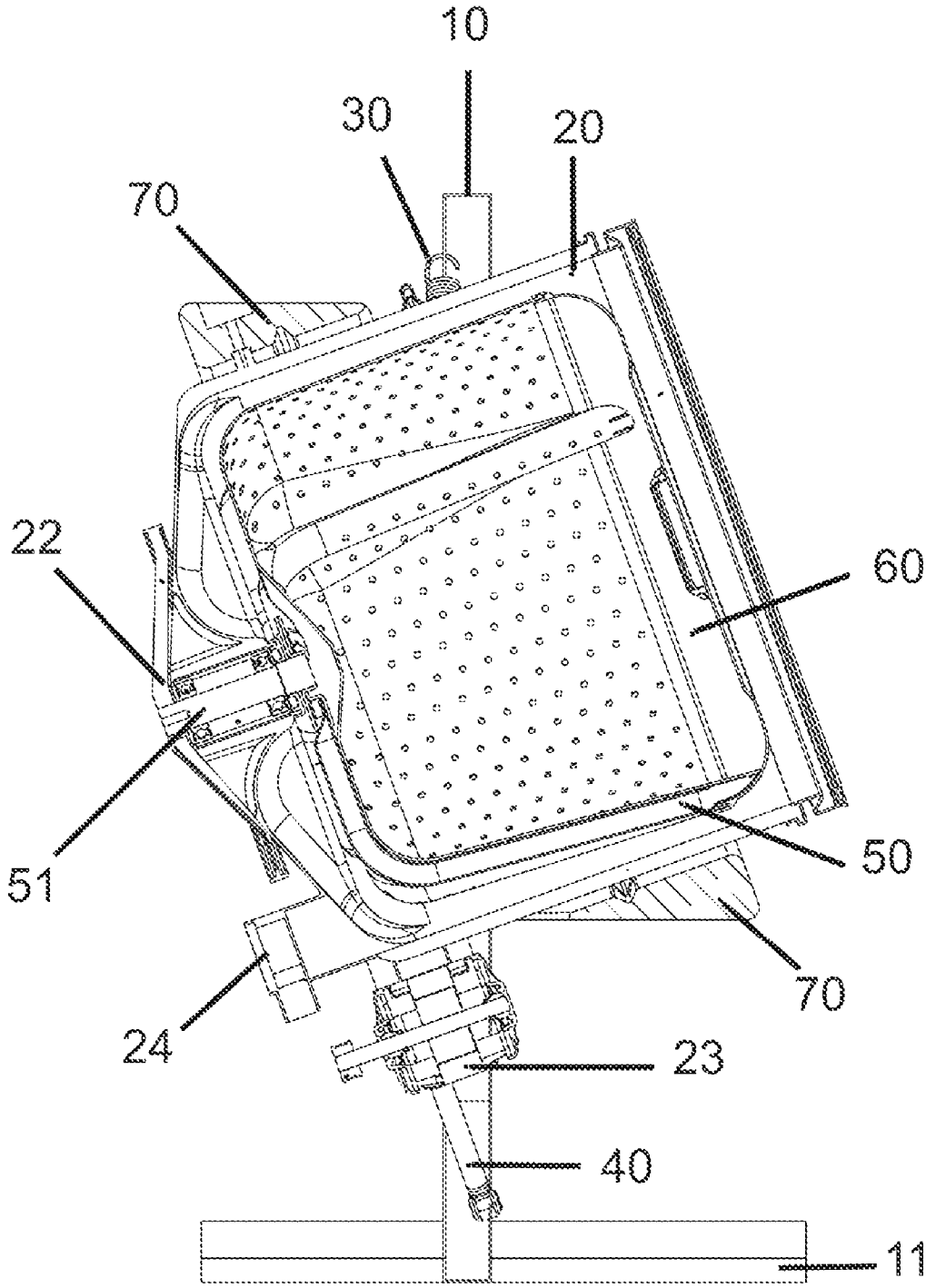
FIG. 3 is a cross-sectional view.
Figure 4:
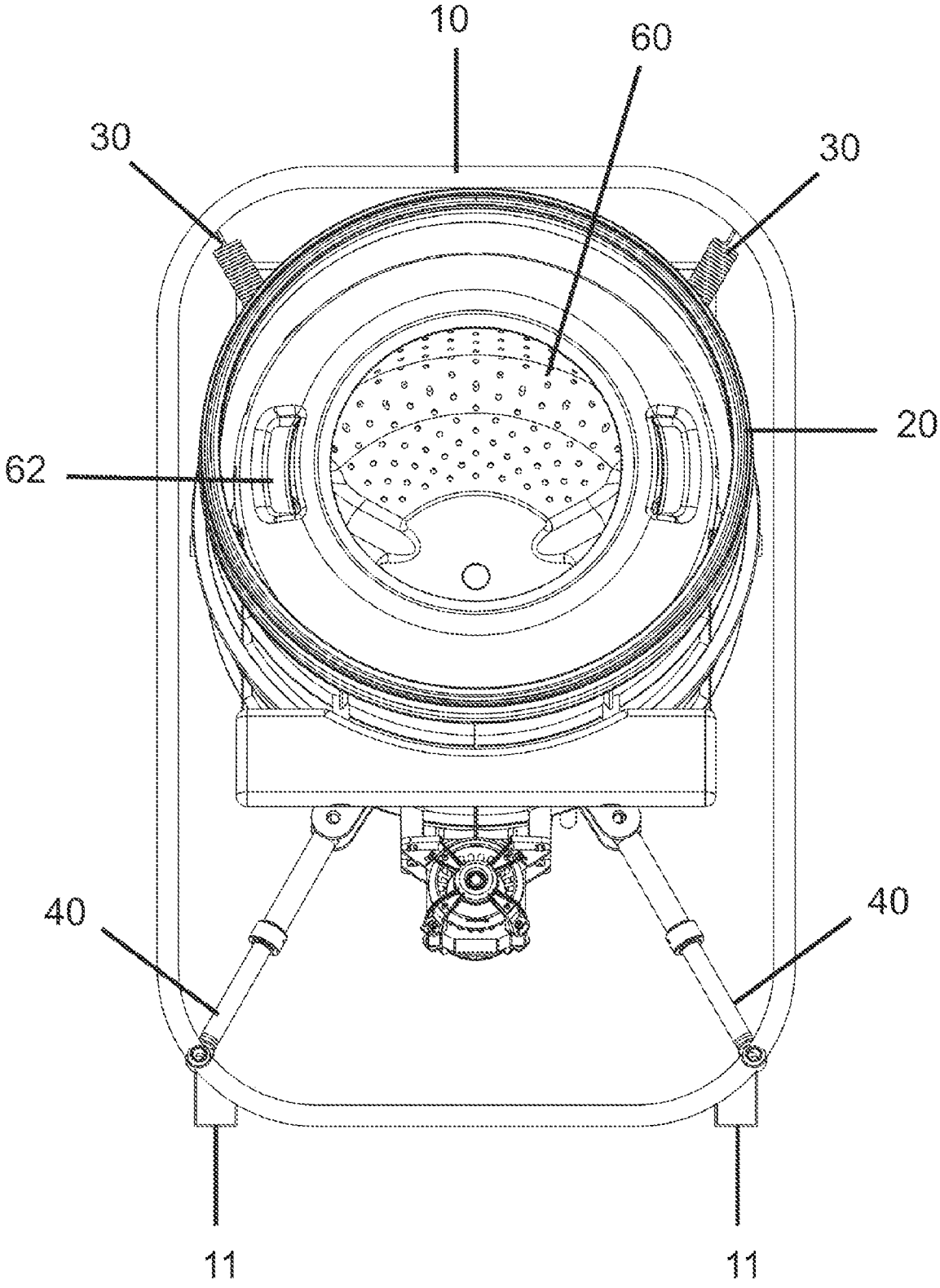
FIG. 4 is a front view.
Figure 5:
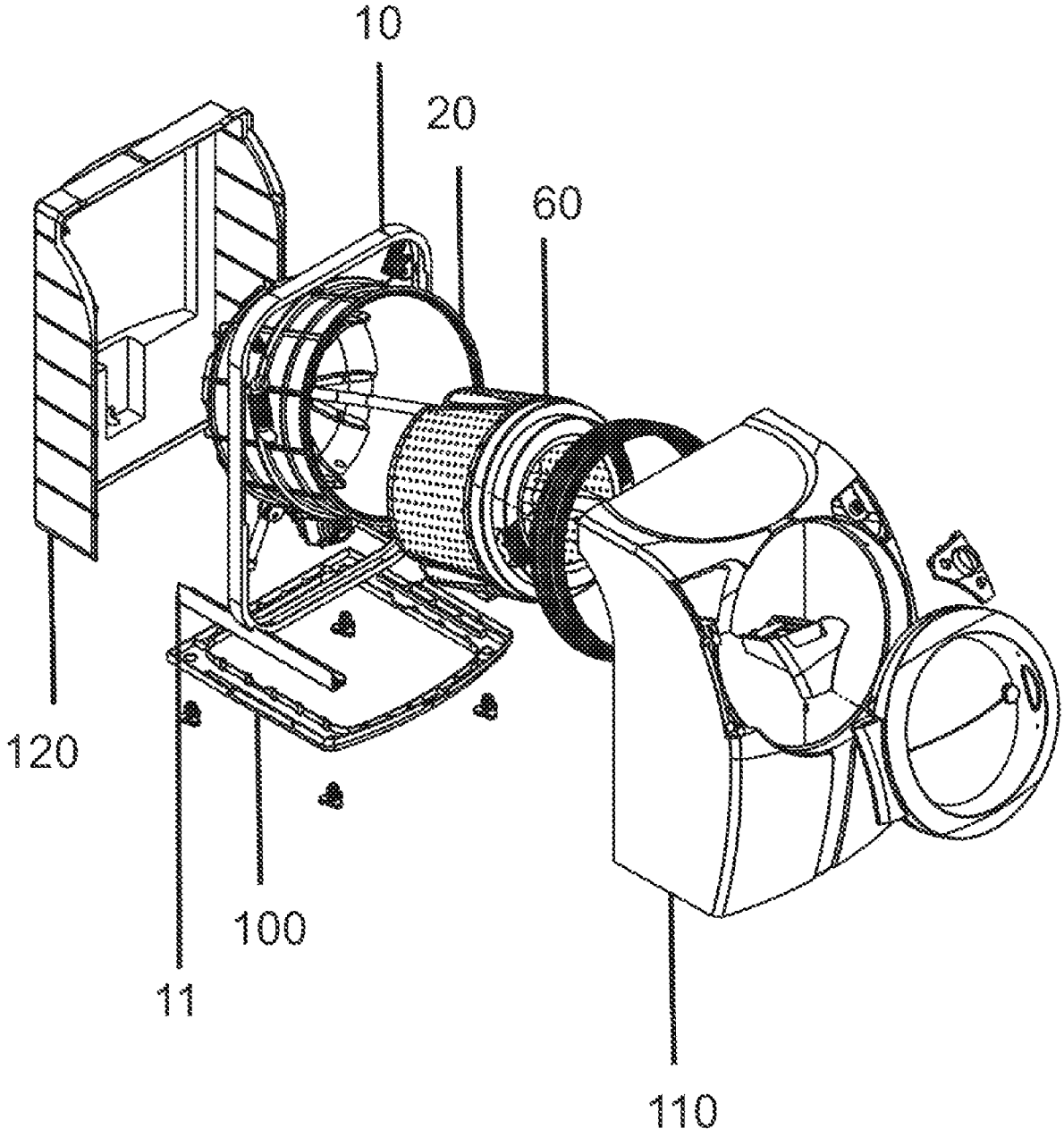
FIG. 5 is an exploded view of the washing machine

The washing machine with a removable basket, subject matter of this invention, comprises a structure for fixing the removable basket (60) that ensures its removal from the inner portion of the tank (20) of the washing machine.

The fixing structure of the tank comprises a frame (10) provided with orthogonal projections (11) on the base, a tank (20) being fastened to the edges of the frame (10) by means of springs (30) on the upper edges and shock-absorbers (40) on the lower edges, said tank (20) being placed at an inclination of between 20 and 90 degrees.

In the intermediary portion of the surface, the tank (20) has a ring (201) that connects the springs (30) with said tank (20).

On the base, the tank (20) has a bearing (21) fixed, in the external extremity, to a moving pulley (21) actuated by a motor (23).

The motor (23) and an electric pump (24) are fixed onto the base of the tank (20).

A structure for supporting the basket (50) is arranged in the inner portion of the tank (20), said supporting structure (50) having a set of arms that follow the shape of the tank (20), said arms being centrally joined on an axis (51) attachable to the bearing (21) of the tank (20) and fastened directly to the mechanical set of the washing machine.

The locks (52) that lock the basket (60) are arranged on the extremity of the arms of the structure for supporting the basket (50).

A removable basket with a surface provided with perforations (60) is arranged in the inner portion of the tank (20) and fixed onto the supporting structure (50) by means of a groove of the arms of the supporting structure (50) in the furrows (61) arranged on the external surface of said removable basket (60).

Actuated by the motor (23), the axis rotates together with the structure for supporting the basket (50), thus rotating the removable basket (60) inside the tank (20) which remains fixed, moving only the support (50) and basket (60) in order to carry out the washing and centrifuging operations of the washing machine.

The removable basket (60) has a recess (62) positioned next to the upper rim and functioning as a catch area.

Weights (70) are arranged on the external surface of the tank (20) in order to stabilize the tank.

The cabinet of the washing machine comprises a base (100) provided with an area with furrows and rims that promote the positioning of the orthogonal projections (11) of the frame (10) and of the front (110) and back (120) structure of said cabinet.

The invention claimed is:

1. Washing machine with a removable basket comprising:

a) a fixing structure of a tank that has a frame provided with orthogonal projections on a base, including springs on upper edges and shock-absorbers on lower edges;

b) a tank that has, in an intermediary portion of a surface, a ring that connects the springs of said tank with the base provided with a bearing fixed, on an external extremity, to a moving pulley actuated by a motor, an electric pump and the motor being fixed onto the base of the tank;

c) a structure for supporting a basket is arranged in an inner portion of the tank, said supporting structure having a set of arms that follow the shape of the tank, with the arms being centrally joined on an axis attachable to the bearing of the tank and fixed directly onto a mechanic set of the washing machine;

d) a removable basket with a surface provided with perforations arranged in the inner portion of the tank and fixed, on the supporting structure, by means of a groove of the arms of the supporting structure, into furrows arranged on an external surface of said removable basket, with the furrows positioned along the sides of the basket.

2. Washing machine with a removable basket, according to claim 1, characterized by the fact that the tank is positioned in the frame at an inclination of between 20 and 90 degrees.

3. Washing machine with a removable basket, according to claim 1, characterized by the fact that locks are arranged on the extremity of the arms of the structure for supporting the basket.

4. Washing machine with a removable basket, according to claim 1, characterized by the fact that the removable basket has a recess positioned next to an upper rim.

5. Washing machine with removable basket, according to claim 1, characterized by the fact that an external surface of the tank has weights to stabilize the tank.

6. Washing machine with removable basket, according to claim 1, characterized by the fact that a cabinet of the washing machine has a base provided with an area with a furrow and rims that promote the positioning the orthogonal projections of the frame and a front and back structure of said cabinet.

* * * * *